US005860164A

United States Patent [19]

Johnson

[11] Patent Number: 5,860,164

[45] Date of Patent: Jan. 19, 1999

[54] FOUR-IN-ONE JACKET

[76] Inventor: Jerry G. Johnson, 456 Logan St. #107, Denver, Colo. 80203

[21] Appl. No.: 666,133

[22] Filed: Jun. 19, 1996

[51] Int. Cl.[6] ..... A41D 1/02

[52] U.S. Cl. ..... 2/94; 2/69; 2/108

[58] Field of Search ..... 2/94, 69, 108, 2/84, 85, 93, 300; 224/575, 576, 577, 153, 578, 579, 580

[56] References Cited

U.S. PATENT DOCUMENTS

| | | | |
|---|---|---|---|
| 4,389,735 | 6/1983 | McLaughlin | 2/94 |
| 4,404,687 | 9/1983 | Hager | 2/94 |
| 4,475,251 | 10/1984 | Hopkins | 2/94 |
| 4,502,155 | 3/1985 | Itoi | 2/94 X |
| 4,563,777 | 1/1986 | Park | 2/108 |
| 4,689,831 | 9/1987 | Greenberger et al. | 2/94 X |
| 4,949,401 | 8/1990 | Kimsey, Jr. | 2/94 X |
| 5,123,117 | 6/1992 | Prendergast | 2/94 X |
| 5,165,111 | 11/1992 | Lieberman | 2/94 |
| 5,407,112 | 4/1995 | Christodoulou et al. | 2/94 X |

*Primary Examiner*—Michael A. Neas
*Assistant Examiner*—Shirra L. Jenkins
*Attorney, Agent, or Firm*—Lee G. Meyer

[57] ABSTRACT

A multi-functional garment includes a combination back-pack, a tote bag, and an article of clothing wherein a pack-pack portion is integrated with the back panel of the article of clothing. The garment is manipulated into its various functional configurations by inverting the back-pack/tote bag portion to reveal or, conversely, conceal the article of clothing. The back-pack/tote bag portion of the garment has a double flap closure to provide alternative closure options for the back-pack/tote bag. The back-pack/tote bag is an integral part of the back panel of the article of clothing and the rear webbing or wall of the back-pack/tote bag near the opening of the pack is topologically continuous, such that the back-pack/tote bag can be inverted to reveal or conceal the article of clothing and the pack shoulder straps are attached near the upper end and next to the opening of the back-pack/tote bag so that the garment can be reconfigured without having to thread the straps through the garment to use it as a back-pack alone or as a garment with the back-pack attached.

20 Claims, 2 Drawing Sheets

FOUR-IN-ONE JACKET

BACKGROUND OF THE INVENTION

1. Field of the Invention

This invention generally relates to multi-purpose garments of the type which are convertible into carrier bags, and pouches; and more particularly, to multi-purpose garments provided with at least one integrally contained compartment wherein the garment may be readily converted into a tote bag or back-pack and the back-pack or tote bag and the garment may be used simultaneously or independently of one another.

2. Description of the Prior Art

Garments which may be converted into carrier bags and/or stored in carrier bags or semi-luggage type carriers are generally well known in the art. It is also known in the art to provide a pouch within the garment, wherein the garment may be stored and carried in the event that the wearer no longer needs the protection of the garment. Totes and carrying bags which contain these garments generally have utility as carrying receptacles for athletic apparel, sporting equipment, hiking paraphernalia, cameras, snacks and the like. Few have any aesthetic appeal or fashion value because of the utility requirement.

It is well known to have a garment and a pouch/carrier arrangement which contains outerwear to allow a wearer retrieval of the garment from the carrier when use of the garment is desired. Generally, however, prior art garments are limited in their functionality and utility, and have proven to be generally unsatisfactory and unworkable in practice in that they have been characterized by elaborate arrangements of secured fasteners, folding procedures, manipulation of straps through the garment, and other complicated and cumbersome procedures and devices for converting the garment into the various utilitarian articles. Specifically, garments that have pouches and/or carrying means into which the garment fit or convert tend to be very cumbersome and provide limited utility to the wearer. Further, prior art configurations which allow the wearer multiple configurations, tend to be mutually exclusive. That is, the wearer must choose between using the garment or the utility bag, but cannot use both.

Because of the configurations and requirements for conversion, these prior art articles of clothing that provide for large capacity utility bags have been aesthetically unpleasing and do not lend themselves to use as stylish or fashionable garments. For example, U.S. Pat. No. 4,404,687 to Hager discloses a poncho-type garment with a topologically located "pouch" across the entire front of the garment. This pouch is adapted to receive the garment by unzipping the entire horizontal top portion of the pouch. The pouch pocket is secured in a topologically continuous relation to the carrying bag pocket, so that the garment and the carrying bag pocket can be stored completely in the pouch. Thus, this configuration does not create an aesthetically fashionable garment because of the presence of the kangaroo-type pouch arrangement on the front of the garment.

Likewise, U.S. Pat. No. 4,689,831 to Greenberger shows a garment with a pocket on the side of the garment and straps convertible into a back-pack on the inside of the garment. The configuration is such that the straps are on the inside and the back-pack cannot be utilized while the jacket is being worn. In order to expose the straps, the garment must be turned into the back-pack configuration.

In U.S. Pat. No. 4,347,629 of Itoi, the straps used with the garment are attached to the back of the jacket. In accordance with this method of attachment, it is required that holes be incorporated into the bag so that the straps are exposed when using the device solely as a back-pack. In this disclosure, all of the non-trunk portions, i.e., the sleeves, collar, etc., are folded or tucked into the back-pack. Additionally, the opening through which the human head protrudes and the sleeves contain zippers, buckles, straps, and the like which allow the closure of the tote bag when the garment is contained therein. Again, this is aesthetically and fashionably unpleasing and makes the garment a utility item and not a fashionable garment.

Thus, it would be highly advantageous to have a fashionable garment that could be configured in many styles and for many purposes; and that was multi-functional, wherein the garment and the back-pack could be used simultaneously, the garment could be turned inside out to conceal the back-pack completely, or the back-pack could be utilized alone, containing the article of clothing or garment, in either a back-pack or tote bag configuration, without the necessity of penetrating the article of clothing in order to provide straps for carrying the back-pack and/or supporting the back-pack on the back of the article of clothing.

It would also be advantageous to have a garment artistic in design, coloration, and fabric as an all-purpose garment which is not activity-specific, i.e., for warmth or functional storage or only for campers and hikers, that has aesthetics and design features pleasing to all wearers and users. It would further be advantageous to have an article of clothing that transforms from one configuration to another in a simple, easy manner so that all configurations are contained in a single garment.

SUMMARY OF THE INVENTION

A multi-purpose, multi-functional, aesthetically pleasing and fashionable combination garment and back-pack/tote bag that can be used as a "tote," with or without a conventional over-the-shoulder strap, or a back-pack having conventional shoulder harness straps, with or without the use of the article of clothing; an article of clothing with back-pack attached, with or without use of conventional harness straps; an article of clothing with back-pack portion secured substantially flush against the back panel of the article of clothing; and an article of clothing capable of being reversed to completely conceal the attached back-pack. The garment is manipulated into its various functional configurations by inverting the back-pack/tote bag portion to reveal, and conversely conceal, the article of clothing. Similarly, the garment can be reversed to conceal the back-pack/tote bag element.

In one embodiment, the back-pack/tote bag portion has a double flap closure to provide alternative closure positions for the flap, whether the back-pack is used alone or as part of the article of clothing, to allow use of the support straps without penetrating the garment.

In the broad aspect, a combination back-pack/tote bag and article of clothing forms a multi-purpose convertible garment assembly wherein the article of clothing is a garment, aesthetically designed for fashion wear, and is attached to a back-pack/tote bag having sides defining an opening, such that the article of clothing can be stored within the back-pack/tote bag by inverting the pack-pack/tote bag. In one configuration the back-pack/tote bag is permanently attached to the back panel of the garment. In another configuration, it is removably attached, such as by a zipper or the like.

In accordance with this invention, an article of clothing, such as a jacket, shirt, or the like, has a back panel or web to which a flexible container, pouch or compartment, such as a back-pack or tote bag, is attached. The flexible container, which can be made of any appropriate material, has an opening and is capable of inversion (i.e., being turned inside out). The back-pack/tote bag is attached to the back web or panel of the article of clothing along at least the top portion of the back-pack/tote bag, proximate the opening thereof.

Thus, the back-pack/tote bag forms a flexible container, compartment or pouch which is capable of inversion to reveal or conversely conceal the garment. In its "inside out" configuration, the compartment holds the compressed garment in concealment and forms a carrying receptacle for the attached garment, preferably with excess carrying capacity for transporting other items.

The flexible container or compartment preferably is serviceable as both a back-pack and a tote bag, and in accordance with this embodiment has a single detachable shoulder strap as well as a pair of spaced apart support straps attached to the top portion of the flexible container, proximate the opening, to support the container as a back-pack in a conventional manner for use as a back-pack alone or in conjunction with the garment. The two shoulder straps are each swivelly attached at the upper end of the back-pack and detachably attached at the lower end of the back surface of the back-pack.

The flexible compartment or back-pack\tote bag has two flaps for closing the opening of the back-pack/tote bag, disposed along an axis substantially parallel to the opening, above and below the point of attachment of the support straps. These closure flaps are disposed on either side of the support straps such that upon inversion of the container they cooperate to provide closure of the back-pack\tote bag opening when only the back-pack or the tote bag is used and when the back-pack is used in conjunction with the garment.

In a preferred embodiment, the garment is reversible such that the article of clothing has an obverse surface and a reverse surface, each of which may be of different color, design, or the like, consistent with a standard reversible article of clothing. The back-pack attached to the back panel of the garment can be flattened in flush alignment with the back panel of the garment in accordance with another embodiment of the invention. In this embodiment, the upper vertical edge of each side of the back-pack contains a row of zipper teeth attached to a substantial portion of the periphery, and a mating row of teeth is attached to a substantial portion of the back panel of the garment, such that when the teeth are matingly engaged, the back-pack is flattened and secured substantially flush with the back panel of the garment. In this configuration, the jacket can be reversed easily, such that the back-pack is concealed on the obverse surface, and the reverse panel surface is exposed.

In accordance with the invention, a flexible compartment means having a back portion, a front portion, and side portions capable of being turned inside out, and defining an opening and having sufficient volume to house an article of clothing, the back panel of which is attached to the flexible compartment means near the opening of the compartment the attachment being positioned substantially horizontally on the back panel of the article of clothing. Preferably, at least one strap is attached to the garment near the opening so that when the garment is worn, the strap may be used to support the compartment, and the strap is positioned so that when the compartment is turned inside-out, the strap can be used to support the compartment containing the. garment.

In accordance with the invention, there is provided a back-pack/tote bag having a front surface, a back surface, a side surface, defining a flexible cavity capable of being turned inside out and having an opening and having a volume at least of sufficient size to store a compressed garment, which back-pack\tote bag is attached to the back panel of a reversible article of clothing.

BRIEF DESCRIPTION OF THE DRAWING

FIG. 1-A is a perspective view of the invention being converted from the tote bag to a back-pack, showing the opening of the back-pack and the dual closure flap configuration along with the configuration of the tote strap and the back-pack straps.

FIG. 2-A is a perspective view of a person re-configuring the back-pack to a garment.

FIG. 2-B is a perspective view of the continuation of the conversion of FIG. 2-A, showing the inversion of the back-pack to reveal the garment.

FIG. 2-C is a perspective view of the continuation of the conversion of FIG. 2-B, showing the further inversion of the back-pack to reveal the totality of the outer garment.

DESCRIPTION OF THE PREFERRED EMBODIMENT

Figure 1:
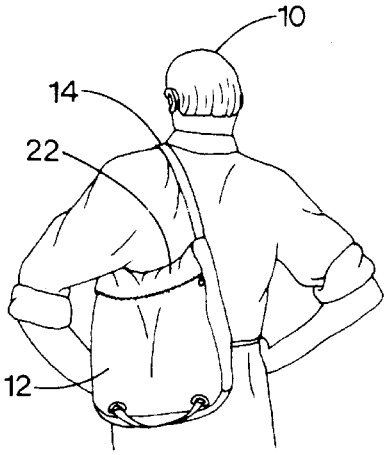

FIGS. 1, 2, 3, 4, 5 and 6 show a wearer, 10, using the invention in its various configurations. In FIG. 1 there is shown the invention in use as a tote bag, 12, having a detachable over-the-shoulder strap, 14, for supporting the tote bag, 12 and a closable flap, 22, to secure opening, 18, of tote bag, 12.

As shown in FIG. 1-A, the strap, 14, has an adjustable buckle, 13, and a detachable fastening clip, 15, which engages a D-ring, 19, attached to the upper portion of bag, 12, preferably near the opening, 18. Tote bag, 12, is a flexible container/compartment, capable of being inverted to expose or reveal garment,40, (not shown). In FIG. 1-A there is shown the conversion of tote bag, 12, into back-pack, 16, where strap, 14, for supporting the tote bag,12, is disengaged, as described below, and tucked within the compartment portion to form the back-pack, 16. The back-pack, 16, has an opening, 18, and a double flap configuration, 20 and 22, for convertibly closing the back-pack, 16, in its configuration as a back-pack alone or as an integral part of the article of clothing back-pack configuration. Closable flaps, 20 and 22, contain closure means along there lower edge to engage the back-pack/tote bag proximate the opening, 18 and secure the opening. Support straps 24 and 26 are attached to the back-pack, 16, in a spaced apart relationship, between the first flap 20 and second flap 22 by means of swivel connectors, 28 and 30.

Figure 2A:
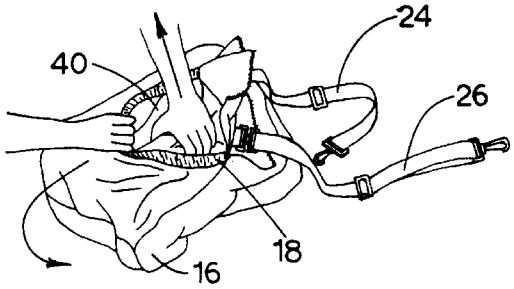
FIG. 2 is rear elevation view of the present invention in use by a wearer as a back-pack solely, with a flap closing the opening.
Figure 2B:
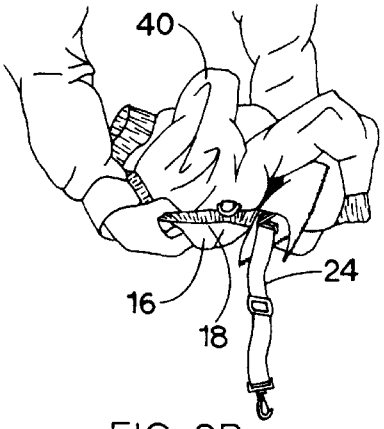
Figure 1A:
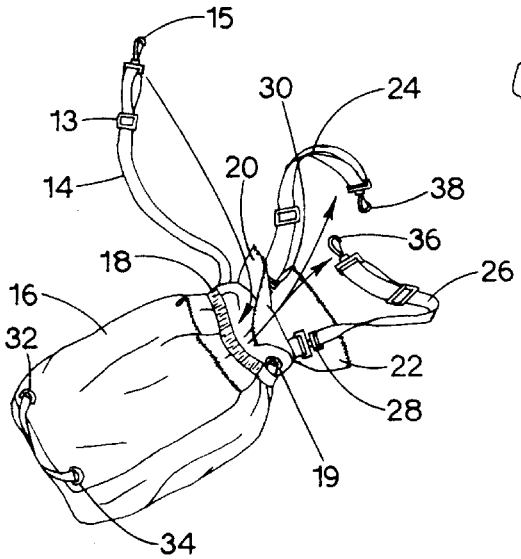
FIG. 1 is a back elevation view of the present invention when used by a wearer as a tote bag.
Figure 2:
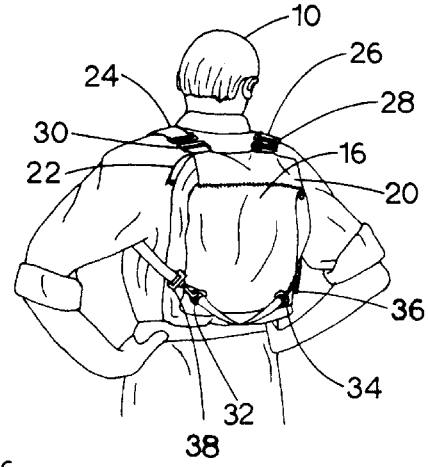

In converting back-pack, 16, into the back-pack from the tote, 12, disengagable clip, 15 on the tote support strap, 14, is disengaged from D-ring, 19, and strap, 14, is then removably stored within the back-pack, 16, through opening, 18. Back-pack support straps 24 and 26 are removed from the cavity of back-pack, 16 through opening 18. Clips, 36 and 38, attached to the ends of support straps, 24 and 26, respectively, as better shown in FIG. 2, are snapped into D-rings, 32 and 34. Turning to FIG. 2, the back-pack, 16, is supported with the garment, 40, contained therein (not shown), by means of back-pack support straps, 24 and 26, which are adjustably secured, in a spaced apart relationship, by means of swivels, 28 and 30, to the top portion of the back-pack, 16, between closure flaps, 20 and 22; and removably connected to D-rings,. 32 and 34 on either side of the lower portion of back-pack, 16, by means of dips, 36 and 38.

There is shown in FIGS. 2-A through 2-C the conversion process and the relative positions of back-pack support straps 24 and 26 as well as the dual closure flaps, 20 and 22. In use, a wearer grasps garment 40 through opening 18 and removes the garment from back-pack compartment 16 by inverting compartment 16 (as shown in FIG. 2-B and FIG. 2-C).

Back-pack, 16, is attached, to the back panel of garment, 40, horizontally along a substantial portion of the back panel and substantially parallel to the edge of the opening, 18, such that inversion of back-pack 16 reveals and conversely conceals attached garment, 40. It will be realized that the back-pack, 16, can be removably attached to the back panel of garment,40, as for example by a zipper. In this manner different style garments could be used with a single back-pack configuration.

Figure 3:
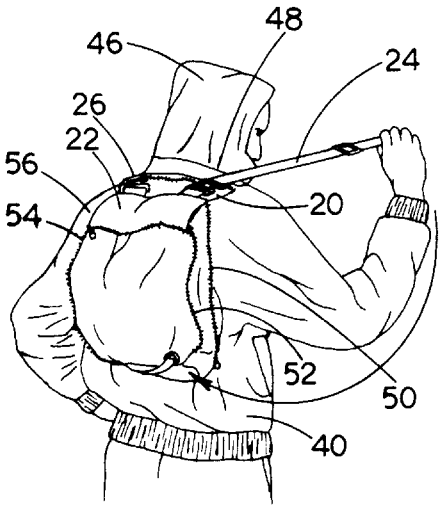
FIG. 3 is a back perspective view of the invention used by a wearer as a garment with back-pack attached, showing the positioning of the straps between the dual closure flaps.
Figure 2C:
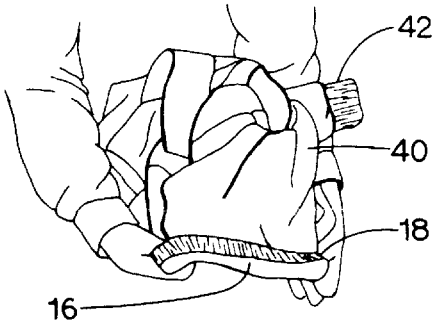

As shown in FIG. 3, garment, 40, with back-pack, 16, and first flap, 20, expose straps, 24 and 26, to be used in conjunction with the garment/back-pack configuration without the necessity of placing holes through the article of clothing when the compartment is inverted to reveal the garment, 40. In this configuration closure flap, 22, is used to secure opening, 18. The garment, 40, can be of any aesthetically pleasing, fashionable configuration, for example having knitted cuffs, 42, and a knitted waistband, 44, and an optional hood, 46, which is concealably stowed in, for example, a zipper collar portion, 48, as better seen in FIG. 5.

Figure 4:
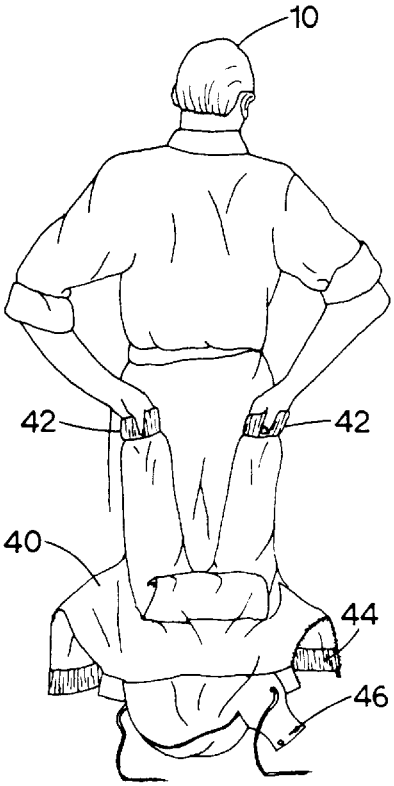
FIG. 4 is a rear elevation view showing the reversible aspect of the outer garment with back-pack in FIG. 3, so that the back-pack is configured and stored on the inside of the garment.

The clips 38 and 36 on straps, 24 and 26, can be detached from D-rings, 32 and 34, and the garment, 40, turned inside out, or reversed as shown in FIG. 4.

Figure 5:
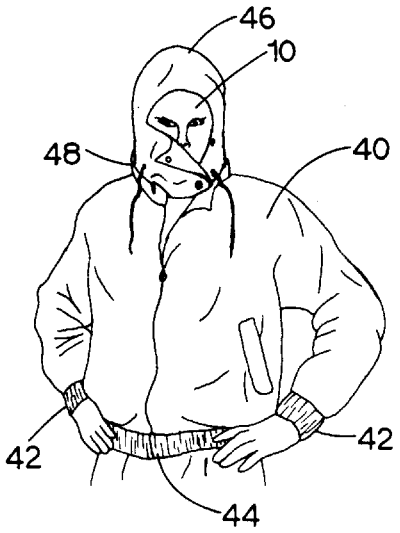
FIG. 5 is a front perspective view showing the reversed garment with the back-pack on the inner back garment panel and optional hood arrangement.
Figure 6:
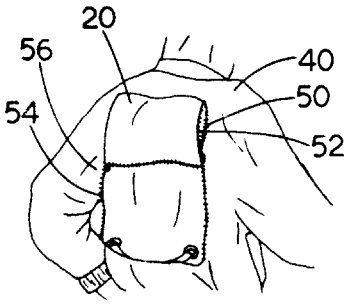
FIG. 6 is a rear perspective view showing the garment with the back-pack flush against the back panel of the garment.

In an alternative embodiment, zippers are provided along each side surface of the back-pack/tote bag and are used to secure the bag to the back surface of the article of clothing. The zippers can zip either upwardly or downwardly to meet the upper end or the lower end of the back surface of the back-pack as it is connected to the back panel of the article of clothing. As better seen in FIG. 3, the garment, 40, contains a row of zipper teeth, 50, which matingly engage a like row of zippered teeth, 52, on the outward edge of back-pack, 16. As better seen in FIG. 6, paired sets of zippered teeth ,50 and 52; and on the opposite side of the pack-pack, 16, paired set of zippered teeth 54 and 56 are used to flatten the back-pack, 16, substantially flush against the back panel of garment, 40, and make it an integral part of the back panel of the article of clothing as depicted in FIG. 6. Thus, the article of clothing can be worn with the back-pack, 16, on the outside, but flattened and substantially flush with straps 24 and 26 placed inside and flap, 20, zippered over the back-pack compartment to allow it to lie flat on the garment. In accordance with FIG. 4, the article of clothing is inverted with sets of zippered teeth 50, and 52 and sets of zippered teeth 54, and 56 in their closed or zipped configuration. Thus, garment, 40, can become a reversible article of clothing as shown in FIG. 5, with no visible signs of the back-pack, 16.

It will be noted that there is a cooperative relationship between closable flaps, 20 and 22, in providing for the various configurations of the instant invention. For example, in FIG. 3, with straps, 24 and 26, exposed to provide support for the back-pack, 16, closable flap, 22, is used to secure opening, 18 (not shown). In FIG. 6, when the pack-pack, 16, is substantially flush against the back panel of garment, 40, closure flap,20, is used to secure the opening and straps,24 and 26 (not shown) are concealed inside the cavity of pack-back, 16.

It will be realized in accordance with the instant invention that other configurations and fashionable styles of the garment, 40, are possible in that the back-pack, 16, and the article of clothing can be used simultaneously or the tote bag/back-pack can be used separately with the article of clothing stowed inside the back-pack, 16, by inverting the back-pack. It will be understood that the configuration of the double flaps, 20 and 22, allows use of the article of clothing with the back-pack flattened against the back panel of outer garment, 40, in cooperation with sets of opposing zippered teeth 50 and 52, and 54 and 56, in their respective zippered configurations with no visible signs of the back-pack supporting straps, 24 and 26.

Having thus described the exemplary embodiments of the present invention, it will be appreciated by those skilled in the art that within the exemplary disclosures are contained various other alternatives, adaptations, and modifications that may be made and are intended to be within the scope of the instant invention. Thus, for example, the openings of the flaps and the means for flattening the compartment, rather than incorporating zippers, could utilize, for example, VELCRO® in various positions. Various other types of devices, clips, and the like may be used to secure, for example, the flaps to close the back-pack/tote bag and/or secure the sides of the back-pack to the article of clothing to allow for the article of clothing to be used without exposing the volume of the back-pack and/or for reversibility of the article of clothing.

It will also be realized that the combination back-pack/article of clothing of the instant invention can be configured in various fashion garments. Because there are no rolled up flaps, compartments, or holes through the garment in order to accommodate reversibility of the straps of the back-pack, various aesthetically pleasing garments can be presented. For example, a short waist coat, a military-type garment, could be fabricated for use on light maneuvers by military personnel or the like. Additionally, a longer waist coat type configuration that would have appeal to, for example, the younger generation or those who just want a convenient carrying means for work or the like, is embodied within the purview of the instant invention. Likewise the garment need not be a coat or jacket but may be a shirt or other garment, preferably of sturdy material, including nylon or water proof fabric.

It will be realized by the skilled artisan that when the straps, either from the tote bag or the back-pack, are placed within the back-pack/tote bag compartment and the upper flap is secured to the front panel of the back-pack/tote bag, there are no protruding straps, swivels or the like to mar the aesthetic value of the combination article of clothing/back-pack/tote bag of the instant invention.

What is claimed is:

1. A combination back-pack/tote bag and article of clothing comprising:

an article of clothing having a back panel;

a flexible container, having sides defining an opening, being able to be turned inside out, and being of a volume at least sufficient to store said article of clothing when said article of clothing is compressed wherein a portion of said back panel of said article of clothing is attached to said flexible container from proximate said opening to a distance spaced apart from said opening and wherein said article of clothing is revealed and conversely concealed by turning said container inside out.

2. The combination back-pack\tote bag and article of clothing of claim 1 further comprising at least one strap, said strap being attached to at least one point on said flexible container or said article of clothing near said opening so that when said article of clothing is worn, said strap may be used to support said container and such that when said container is turned inside out, said article of clothing can be stored within said compartment and said strap can be used to support said container.

3. The combination back-pack\tote bag and article of clothing of claim 2 wherein said at least one strap comprises two shoulder straps in spaced apart relationship, each of said shoulder straps being attached at the upper end of said back-pack\tote bag and at the lower end of said back-pack\tote bag.

4. The combination back-pack\tote bag and article of clothing of claim 2 further comprising at least one closure flap attached proximate said opening for securing said opening.

5. The combination back-pack\tote bag and article of clothing of claim 4 wherein said at least one closure flap comprises two flaps in spaced apart relationship for independently securing said opening.

6. The combination back-pack\tote bag and article of clothing of claim 5 wherein said at least one strap further comprises two shoulder straps in spaced apart relationship, each of said shoulder straps being attached at the upper end of said back-pack\tote bag and at the lower end of said back-pack\tote bag and wherein said shoulder straps are disposed between said two flaps.

7. The combination back-pack\tote bag and article of clothing of claim 1 wherein said article of clothing is reversible, having an obverse surface and a reverse surface.

8. The combination back-pack\tote bag and article of clothing of claim 7 further comprising means for temporarily storing said back-pack against the obverse side of said article of clothing in a flattened configuration substantially flush with said obverse surface.

9. The combination back-pack\tote bag and article of clothing of claim 8 wherein said means for temporarily storing said back-pack against said article of clothing comprises at least one zipper means having a first row of zipper teeth attached to a substantial portion of said back panel of said article of clothing and a mating row of teeth attached to a substantial portion of the periphery of the back surface of said back-pack such that when the two rows of teeth are matingly engaged, said back-pack is in a flattened and stored position substantially flush with the back panel of said article of clothing.

10. A multi-purpose convertible garment assembly comprising:

a flexible compartment means having a back portion, a front portion, and sides defining an opening, capable of being turned inside out and having a volume at least as great as that necessary to house a garment;

a garment, having a back panel to which is attached said compartment means near the opening of said compartment means to a distance spaced apart from said opening; and, at least one strap means, said strap means being attached to a said convertible garment assembly near said opening of said compartment means such that when said garment is worn, said strap means can be used to support said compartment means and such that when said compartment is turned inside-out said garment is stored within said compartment and said strap means can be used to support said compartment means.

11. The multi-purpose convertible garment assembly of claim 10 further comprising at least one closure flap means attached to said garment assembly means proximate said opening for securing said opening.

12. The multi-purpose convertible garment assembly of claim 11 wherein said at least one closure flap means comprises two closure flaps in spaced apart relationship such that each of said flaps can independently secure said opening.

13. The multi-purpose convertible garment assembly of claim 12 wherein said strap means comprises two shoulder straps in spaced apart relationship, one end of each of said shoulder straps being attached to the garment assembly between said two flaps.

14. The multi-purpose convertible garment assembly of claim 13 wherein said article of clothing is reversible, having an obverse surface and a reverse surface.

15. A multi-purpose convertible garment assembly comprising:

a flexible container means having sides defining an opening and being capable of being turned inside out;

a garment wherein said container means is attached to the back of said garment near the opening of said container means to a distance spaced apart from said opening;

a closure means for securing said opening of said container means in at least two positions, said closure means being attached to said garment assembly near the opening of said container means; and, at least one strap means, said strap means being attached to said garment assembly proximate said closure means such that when said garment is worn, said strap means can be used to support said container means and said closure means can be used in a first position for securing said opening; and, such that when said container means is turned inside-out, said garment is stored within said container means and said strap means can be used to support such container means and said closure means can be used in a second position for securing said opening.

16. The multi-purpose convertible garment assembly of claim 15 wherein said article of clothing is reversible, having an obverse surface and a reverse surface.

17. The multi-purpose convertible garment assembly of claim 16 further comprising means for temporarily storing said container means against the obverse surface of said garment in a flattened configuration substantially flush with said obverse surface.

18. The multi-purpose convertible garment assembly of claim 17 wherein said means for temporarily storing said container means against the obverse surface of said garment in a flattened configuration comprises at least one zipper means having a first row of zipper teeth attached to a substantial portion of said back of said garment and a mating row of teeth attached to a substantial portion of the periphery of the back surface of said container means such that when the two rows of teeth are matingly engaged, said container means is in a flattened and stored position substantially flush with the back panel of said garment.

19. The multi-purpose convertible garment assembly of claim 15 wherein said closure means comprises two closure flaps in a spaced apart relationship for independently securing said opening.

20. The multi-purpose convertible garment assembly of claim 19 wherein said strap means comprises two shoulder straps in spaced apart relationship, one end of each of said shoulder straps being attached to the garment assembly between said two flaps.

* * * * *